United States Patent [19]

Hines

[11] 4,397,502

[45] Aug. 9, 1983

[54] TWO-PASS METHOD FOR DEVELOPING A SYSTEM OF IN SITU OIL SHALE RETORTS

[75] Inventor: Alex E. Hines, Clifton, Colo.

[73] Assignee: Occidental Oil Shale, Inc., Grand Junction, Colo.

[21] Appl. No.: 233,004

[22] Filed: Feb. 9, 1981

[51] Int. Cl.[3] ..... E21C 41/10

[52] U.S. Cl. ..... 299/2; 299/19

[58] Field of Search ..... 299/2, 19

[56] References Cited

U.S. PATENT DOCUMENTS

| | | | |
|---|---|---|---|
| 4,017,119 | 4/1977 | Lewis | 299/2 |
| 4,140,343 | 2/1979 | Mills | 299/2 |
| 4,153,299 | 5/1979 | Kvapil et al. | 299/2 |
| 4,219,237 | 8/1980 | Sisemore | 299/2 |

*Primary Examiner*—Ernest R. Purser

*Attorney, Agent, or Firm*—Christie, Parker & Hale

[57] ABSTRACT

A two-pass in situ oil shale retorting system uses two separate gas levels for withdrawing off gas from producing in situ oil shale retorts. During a first pass of retorting through an oil shale tract, spaced apart groups of in situ oil shale retorts are formed, leaving intervening barrier pillars of unfragmented formation between adjacent groups of retorts. During retorting, off gas from the retorts formed in the first pass is withdrawn to a first gas level drift system. Thereafter, during a second pass of retorting, intervening groups of in situ oil shale retorts are formed in the intervening barrier pillars between the groups of in situ retorts formed in the first pass. During retorting in the retorts formed in the second pass, off gas is withdrawn to a second gas level drift system that is formed at a different level and isolated from the first gas level drift system so that gas flow between the two gas levels is avoided. This permits both passes of retorting operations to progress across the oil shale tract at the same time with the second pass operations being only a few years behind the first pass.

35 Claims, 3 Drawing Figures

Fig. 2
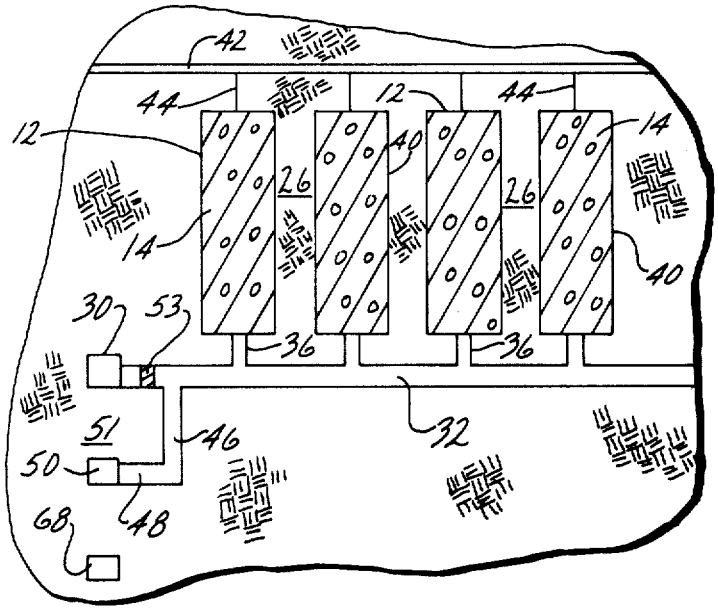
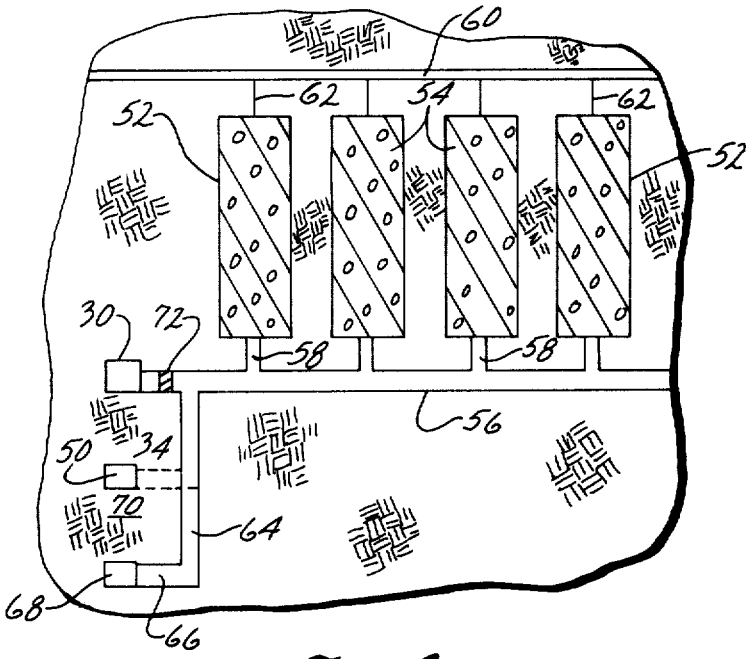
Fig. 3

TWO-PASS METHOD FOR DEVELOPING A SYSTEM OF IN SITU OIL SHALE RETORTS

BACKGROUND OF THE INVENTION

1. Field of the Invention

This invention relates to in situ recovery of shale oil; and more particularly to a two-pass method of developing a system of in situ oil shale retorts, in which retorts developed in a second pass interleaved with retorts in a first pass are isolated from toxic off gas produced from retorts developed in the first pass.

2. Description of the Prior Art

The presence of large deposits of oil shale in the semi-arid high plateau region of the Western United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,043,596; 4,043,597; 4,043,598; and 4,192,554, which are incorporated herein by this reference. These patents describe in situ recovery of liquid and gaseous hydrocarbon materials from a subterranean formation containing oil shale, wherein such formation is explosively expanded for forming a stationary fragmented permeable mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the fragmented mass and advancing the combustion zone through the fragmented mass. In the combustion zone, oxygen from the retort inlet mixture is depleted by reaction with hot carbonaceous material to produce heat, combustion gas and combusted oil shale. By continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

The off gas can contain nitrogen, hydrogen, carbon monoxide, carbon dioxide, water vapor, methane, and other hydrocarbons and sulfur compounds such as hydrogen sulfide. Carbon monoxide and hydrogen sulfide contained in the off gas are extremely toxic.

Off gas can be withdrawn from the bottom of active retorts and conveyed to a gas collection drift system. Such a gas collection drift system is disclosed in U.S. Pat. No. 4,140,343, which is incorporated herein by reference.

The gas collection drift system can be dedicated to collecting off gas from active retorts, i.e., the gas collection drifts can be isolated or sealed off to avoid leakage of off gas into adjacent areas where personnel are working.

It is desirable from an economic standpoint to excavate and develop in situ retorts in one region of an oil shale tract while retorting operations are carried on in another region of the oil shale tract. This is more economical than completing the entire system of retorts in the tract before retorting has started. However, precautions must be taken to ensure that workers in the retort development regions are not exposed to toxic off gas from active retorts in the production region.

It is desirable to maximize the amount of oil shale subjected to retorting within a region of formation being developed. It is also important to avoid subsidence in a tract of in situ oil shale retorts. There is a trade-off between retorting as much oil shale as possible to miximize resource recovery, and leaving sufficient unrecovered oil shale in the supporting pillars of unfragmented formation for supporting the weight of the overburden to avoid subsidence. Subsidence can result in fracturing of overburden with consequent leakage of water from overlying aquifiers into retort or mining areas, leakage of gas from completed retorts, leakage of air into retorts during retorting operations, and safety hazards in underground workings containing operating personnel. Such subsidence can occur when the extraction ratio in the tract is large and the remaining unfragmented formation is not sufficient for supporting the weight of the overburden.

In addition to increased stability against subsidence, a large intervening barrier pillar provides a greater resistance to air or gas leakage to or from a retort along naturally occurring (pre-existing) channels of higher permeability because of the greater distance to adjacent workings (i.e., the same principle as a labyrinth bearing seal), and the greater possibility of termination of a permeable channel in the case of discontinuous channels. In addition, the large intervening barrier pillar provides a greater barrier to heat flow from active or spent retorts into adjacent workings from damage attributed to seismic waves generated from blasting for forming a fragmented mass.

In order to maximize resource recovery while avoiding substantial subsidence of overburden, it has been proposed to develop a tract of in situ oil shale retorts by forming the retorts in rows, with the retorts in each row being relatively closely spaced and with substantial barrier pillars between adjacent rows of retorts. Such an arrangement provides support for overlying formation and protects underground workings, but the proportion of total shale oil resource recovered is diminished by the proportion of unretorted oil shale left in the barrier pillars. However, it has been proposed that additional in situ oil shale retorts be formed in the barrier pillars after initial retorting operations have been completed. Such a method of developing the oil shale tract can be referred to as a two-pass system, and an example of such a two-pass system is described in U.S. Pat. No. 4,219,237 to Sisemore.

In a two-pass system of developing in situ oil shale retorts, arrangements must be provided for subsequently retorting the barrier pillars without exposing workers to hazardous off gas.

Complete development of a tract with in situ oil shale retorts can take 40 years or more. It is desirable to commence formation and operation of retorts in the barrier pillars as soon as it is safe to do so, instead of waiting until the entire tract is developed during the first pass of retort development operations. This provides a convenient way of increasing the rate of production with limited additional capital investment.

SUMMARY OF THE INVENTION

This invention provides techniques for developing an in situ oil shale retort system in multiple passes, in which retorting operations can be commenced in the retorts developed in the first pass while development work is being carried out for retorts in the second pass; and in which workers carring out the second pass development work are isolated from toxic off gas produced during retorting operations in retorts developed during the first pass. This can be accomplished using separate isolated drift systems for withdrawing off gas from retorts developed in the first and second passes of retorts.

Briefly, one embodiment of the invention provides a method for developing a system of in situ oil shale retorts formed in a subterranean formation containing oil shale. Each in situ oil shale retort contains a fragmented permeable mass of formation particles containing oil shale. A first set of in situ oil shale retorts is formed in a first pass through the subterranean formation. Separate groups of in situ retorts in the first set are separated by intervening zones of unfragmented formation. A first gas level drift system communicates with fragmented masses of the groups of in situ retorts separated by such intervening zones of unfragmented formation for withdrawing off gas from such retorts. A second set of in situ oil shale retorts are formed in such intervening zones of unfragmented formation during a second pass through the subterranean formation. A second gas level drift system communicates with fragmented masses of the second set of retorts for withdrawing off gas from such retorts. The second gas level drift system is isolated from the first gas level drift system for inhibiting gas flow between the two gas level drift systems.

Thus, resource recovery can be maximized, owing to the use of a two-pass retorting method; while the dual gas level drift system enables the second pass of retorting operations to be conducted under safe conditions and under conditions which are economical because the second pass can be commenced before waiting for completion of retorting operations in retorts formed during the first pass.

DRAWINGS

These and other aspects of the invention will be more fully understood by referring to the following detailed description and the accompanying drawings, in which:

FIG. 2 is a fragmentary, schematic vertical cross-sectional view illustrating a first gas level system for a first group of in situ oil shale retorts; and FIG. 3 is a fragmentary, schematic vertical cross-sectional view showing a second gas level drift system for a second group of in situ oil shale retorts.

DETAILED DESCRIPTION

Figure 1:
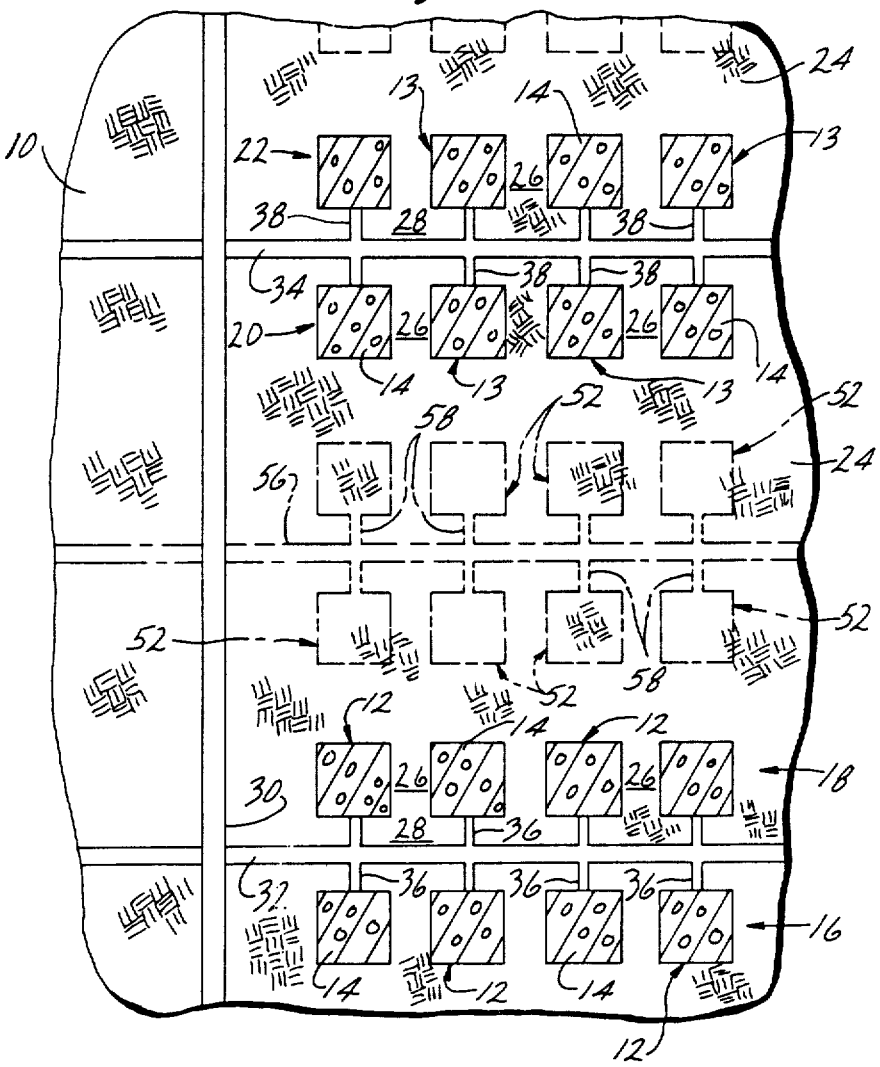
FIG. 1 is a fragmentary, schematic cross-sectional plan view illustrating an intermediate step in a method of developing an oil shale tract according to principles of this invention, in which spaced apart rows of in situ oil shale retorts are separated by an intervening zone of unfragmented formation.

The drawings illustrate one embodiment of a method for developing a system of in situ oil shale retorts in an oil shale tract within a subterranean formation 10 containing oil shale. The retorts are formed in two passes of retorting operations through the oil shale tract. A first set of in situ oil shale retorts are formed and retorting operations are conducted in a first pass of retorting operations through the oil shale tract. Thereafter a second set of retorts are formed and retorting operations are conducted during a second pass of retorting operations through the oil shale tract. The first pass need not be completed before the second pass commences. Retorts in the second pass are interleaved between spent retorts from the first pass.

FIG. 1 is a schematic cross-sectional plan view showing a section of the oil shale tract being developed according to principles of this invention. FIG. 2 is a schematic, vertical cross-section through a region of the oil shale tract during the first pass of retorting operations. It should be recognized that the vertical and horizontal views of the drawings are not necessarily consistent in locations of features since the drawings are intended as schematic for showing the principles rather than exact locations and geometries of the retorts, drifts, raises, and the like which are not critical to practice of this invention.

In the embodiment illustrated in FIG. 1, a first set of in situ oil shale retorts are arranged in separate groups of retorts formed in separate spaced apart regions within the oil shale tract. FIG. 1 illustrates only a portion of the retorts in the first set, which includes a first group of retorts 12 formed in one region of the oil shale tract and a second group of retorts 13 formed in another region spaced from the first group of retorts. Other groups of retorts within the first set are located at other spaced apart regions of the oil shale tract, but not shown in FIG. 1. Each in situ oil shale retort in the first set is outlined by solid lines in FIG. 1 and represents an individual in situ oil shale retort which, when completed by explosive expansion techniques, comprises a fragmented permeable mass 14 of formation particles containing oil shale, also illustrated in FIG. 2. The retorts can be formed by explosive expansion techniques such as those described in the prior patents incorporated by reference above.

In situ retorts within each group can be arranged in one or more rows. In the illustrated embodiment, the first group of retorts 12 within the first set are formed in two parallel rows 16, 18; and the second group of retorts 13 within the first set are also formed in two parallel rows, 20, 22. These two groups of retorts are separated by a barrier pillar 24 of unfragmented formation, also referred to herein as an intervening zone of unfragmented formation. Other groups of retorts within the first set also are separated by similar barrier pillars of unfragmented formation not shown in FIG. 1. Thus, there are intervening zones of unfragmented formation interleaved between adjacent groups of in situ retorts in the first set of retorts.

The groups of retorts in the first set are preferably generally equidistantly spaced apart from one another; and the retorts within each row also are preferably generally equidistantly spaced apart from one another along the length of each row, leaving vertically extending partitions or gas barriers 26 of unfragmented formation between the ends of adjacent fragmented masses in each row. Within each group of retorts, the retorts in one row are separated from the retorts in the other row by a vertical gas barrier 28 of unfragmented formation. Although illustrated as square in horizontal cross-section in FIG. 1, it will be apparent that the horizontal crosssection of the retorts can be rectangular or any other convenient shape.

The barrier pillars 24 of unfragmented formation extend parallel to one another and are substantially wider than the narrow partitions or gas barriers that separate the ends of adjacent retorts in each row. The barrier pillars of unfragmented formation are sufficiently wide to provide space for corresponding groups of retorts of a size similar to those groups of retorts within the the first set. The narrow partitions or gas barriers 26 of unfragmented formation separate the fragmented masses within a given row from one another and act as a gas seal for isolating retorting operations in the fragmented masses within each row from one another. The gas barriers 28 similarly separate retorting operations in one row of retorts from retorting operations in an adjacent row. The wider barrier pillars of unfragmented formation act as gas barriers or pillars isolating retorting operations in the retorts in one group from retorting operations in the retorts in adjacent groups. The barrier pillars of unfragmented formation also support overburden loads above the retorts.

The in situ retorts 12, 13 within each group of retorts are generally rectangular in horizontal cross-section. In one embodiment, the retorts are substantially square in horizontal cross-section, approximately 160 feet wide along each side, and approximately 300 feet high. The partitions of unfragmented formation 26 that separate the retorts within each row are approximately 50 feet thick. This thickness is sufficiently small to maximize resource recovery while providing barriers that are thick enough to provide adequate gas seals between retorts for isolating retorting operations in the different retorts from one another. The gas barriers 28 of unfragmented formation that separate the rows of retorts within each group are approximately 100 feet thick. These dimensions are exemplary only and are set forth for the purpose of indicating principles of the invention.

The first set of retorts are part of a retorting system which includes a main production level access drift 30 extending horizontally through the oil shale tract adjacent the groups of retorts in the first set of retorts. A first production level cross drift 32 extends laterally from the main production level access drift toward the first group of retorts 12 for providing access to the first group of retorts 12 formed in the first pass of retorting operations. A second production level cross drift 34 extends laterally from the main production level access drift toward the second group of retorts 13 for providing access to the second group of in situ retorts formed in the first pass. Other similar cross drifts (not shown) extend from the main production level access drift to other groups of in situ retorts that are formed in the first pass but not illustrated in the drawings. The cross drifts are at an elevation below the bottom boundaries of the retorts; and in the illustrated embodiment, the first cross drift 32 extends between the two rows of retorts 12 in the first group and is connected to the retorts in the two rows by stub drifts 36. Similarly, the second cross drift 34 extends between the two rows of retorts 13 in the second group of retorts, and the cross drift 34 is connected to the retorts in both rows by stub drifts 38.

Although one stub drift is shown extending from each fragmented mass to a corresponding cross drift at the production level, it should be emphasized that other means for providing fluid communication between the production level cross drift and each fragmented mass can be provided. For example, more than one raise or stub drift can extend from separate locations at the bottom of each fragmented mass into the production level cross drift; or a single production level cross drift can be excavated directly below the fragmented masses in each row, and one or more vertical or diagonal raises can provide fluid communication between the lower portion of each fragmented mass and the production level cross drift. Alternatively, the cross drifts and main production level access drift can be at about the same elevation as the bottom of the retorts and communicate with the fragmented mass at one side of the bottom.

In the first pass of retorting operations each group of in situ oil shale retorts has a corresponding production level drift system. The individual production level drift systems can communicate independently with the main production level access drift 30. The production level drift systems also can be used for excavation of oil shale for forming void spaces within the retort sites prior to explosive expansion for forming the fragmented masses. Alternatively the production level drift system for withdrawing off gas can be at an elevation below the bottom of the retorts and an additional drift system can be provided at about the elevation of the bottom of the retorts for excavating voids within the retort sites. A variety of such drift systems can be employed in practice of this invention.

FIG. 2 illustrates schematically, in vertical cross-section, completed in situ oil shale retorts 12 in one of the rows 16 or 18 of retorts within the first group of retorts formed in the first pass of retorting operations. The fragmented mass 14 within each in situ retort is formed within vertical side boundaries of unfragmented formation surrounding the fragmented mass. An air level drift 42 extends above each group of retorts, and a plurality of feed gas inlet passages 44 are drilled downwardly at angles from the air level drift to the top boundary of each fragmented mass so that oxygen containing gas can be supplied to each fragmented mass during retorting operations. The air level drift system and the production level drift system, as well as the configurations of the retorts as illustrated, are exemplary only, since other arrangements can be used without departing from the scope of the invention. For example, the retorts can be rectangular with their long dimensions extending generally parallel to the rows of retorts, or a separate air level drift can be excavated above each row of retorts; or a separate air level void having approximately the same horizontal cross-section as each retort can be excavated above each fragmented mass, for use as an upper working level, if desired, or oxygen supplying gas can be introduced from the surface with no separate subterranean air level drift system.

A first gas collection drift system is provided for the first set of in situ retorts formed during the first pass of retorting operations. The first gas collection drift system includes a gas collection raise or winze 46 extending between from the first production level cross drift 32 and a lateral gas collection drift 48. The lateral gas collection drift extends from the bottom of the gas collection raise to a first gas level main drift 50 excavated at an elevation below the elevation of the main production level access drift 30. The first gas collection drift system also includes a similar gas collection raise and lateral drift (not shown) providing gas communication between the second production level cross drift 34 of the second group of retorts 13 and the first gas level main drift 50. Further, other groups of in situ retorts developed during the first pass of retorting operations can have a similar gas collection raise and lateral drift for providing gas communication between the first gas level main drift 50 and the production level cross drifts excavated below such additional groups of in situ retorts.

Thus, the groups of in situ oil shale retorts formed during the first pass are connected to a common gas level drift system. The common gas level drift system is excavated at a different elevation from the production level drift system for the same set of retorts so that a barrier 51 of unfragmented formation that inhibits gas flow between the two drifts; and barriers of unfragmented formation isolate the rest of the first gas level drift system from the first production level drift system for inhibiting gas flow between the two drift systems. A gas-tight bulkhead 53 can be erected in each production level cross drift for preventing flow of off gas into the main production level access drift.

Retorting operations are conducted in the fragmented masses within the retorts formed during the first pass for recovering liquid and gaseous products. Retorting operations can be conducted in any pattern, however, it is desirable to retort several retorts (such as six) in each group of retorts as a single module. Retorts in adjacent groups also can be retorted together as a cluster. Retorts within the first set can be retorted progressively by retorting each group or groups of retorts in sequence progressing across the oil shale tract. Retorting operations can be commenced in some retorts within the first set, while other retorts within the first set are in the process of being developed.

During retorting operations, formation particles at the top of each fragmented mass are ignited to establish a combustion zone at the top of such a fragmented mass. Air or other oxygen-supplying gas is introduced to the combustion zone through the feed gas inlet passages 44 to the tops of the fragmented masses. Combustion gas produced in the combustion zone passes through each fragmented mass to establish a retorting zone on the advancing side of the combustion zone where kerogen in the fragmented mass is converted to liquid and gaseous products. Liquid products, namely, shale oil and water, produced during operation of each retort and an off gas containing gaseous products of retorting, combustion gas and unburned portions of the inlet mixture are withdrawn by way of the production level cross drift 32 of each group of retorts.

The gas-tight bulkhead 53 installed in the first cross drift 32 prevents off gas from entering the main production level access drift 30 from the first group of retorts 12. Similar bulkheads can be installed in similar locations in other production level cross drifts for other groups of retorts formed during the first pass. Off gas is withdrawn from each production level cross drift 32 by the gas collection raise 46 and lateral drift 48 connecting the production level cross drift to the first gas level main drift 50. The shale oil and water can be withdrawn separately by way of the production level drift and passed to above ground.

Although not illustrated in the drawings, it will be apparent that arrangements can be provided for forming additional retorts in the row or rows connected to the lateral cross drift 32 while other retorts connected to that drift are in the midst of retorting operations. This can be provided, for example, by an additional main production level access drift connected to the opposite end of the production level cross drift 32 and other similar production level cross drifts associated with other groups of retorts formed during the first pass of retorting operations.

Completion of retorting operations in the fragmented masses formed during the first pass of retorting operations leaves groups of spent in situ oil shale retorts; that is, retorts containing spent oil shale from which kerogen has been retorted. After the first pass of retorting operations when at least a portion of the retorts within the first set of retorts are spent, development of a second set of retorts in the barrier pillars 24 can be commenced. The time interval between completion of retorting operations in the groups of retorts retorted in the first pass and commencement of operations for a second pass of retorting in adjacent barrier pillars can be a few years to permit safe operation. During this time interval, substantial cooling of the spent retorts can occur and evolution of noxious and toxic gases can decrease to nominal and safe values.

If desired, in preparation for the second pass of retorting, the fragmented masses in the spent in situ retorts can be stabilized. A stabilizing material is introduced into the void spaces in the fragmented masses within the spent in situ oil shale retorts for increasing the compressive strength of each spent in situ retort. Such a stabilizing material can, for example, be finely divided spent oil shale from above-ground retorting reintroduced into the void spaces in each fragmented mass of spent in situ oil shale particles. If desired, a cementitious grout can be introduced into the void spaces in the spent oil shale particles for increasing the compressive strength of the spent in situ retorts. Such stabilizing material can be introduced as a slurry through the inlet passages 44 leading to the tops of the spent in situ retorts; or such stabilizing material can be introduced as described in U.S. Pat. Nos. 4,120,355 to Knepper, 4,131,416 to Watson et al; or 4,219,237 to Sisemore.

After the fragmented masses in the first set of retorts are stabilized they are capable of supporting a substantial portion of the weight of the overburden without substantial subsidence.

During the second pass of retorting, a second set of in situ oil shale retorts are formed in the barrier pillars 24 of unfragmented formation between adjacent groups of retorts that were formed in the first pass. The retorts are formed in the second pass in a manner similar to the first pass. That is, each group of retorts formed in the second pass can be in two parallel rows of retorts. In the illustrated embodiment, the second set of retorts includes a first group of in situ retorts 52 (shown in phantom lines in FIG. 1 and outlined in solid lines in FIG. 3), each retort containing a fragmented permeable mass of formation particles 54 containing oil shale. A production level drift system for the second set of retorts includes a first production level cross drift 56 excavated laterally from the main access drift 30 for providing access at the production level to the first group of retorts 52 in the second set. A similar cross drift is excavated at the production level below each additional group of retorts formed in the second pass. Each cross drift extends below the bottoms of the retorts in each row and between the two rows of retorts in each group; and the cross drift is connected to the retorts in both rows by stub drifts 58. An air level drift 60 and a plurality of feed gas inlet passages 62 deliver oxygen-supplying gas to the fragmented masses during retorting operations in the retorts formed during the second pass; or a separate air level void having approximately the same horizontal cross-section as each retort can be excavated above each fragmented mass, for use as an upper working level; or oxygen supplying gas can be introduced from the surface with no separate subterranean air level drift system.

A second gas collection drift system is provided for the second set of in situ retorts formed during the second pass of retorting operations. The second gas collection drift system includes a gas collection raise 64 extending downwardly from the production level cross drift 56 and a lateral gas collection drift 66 extending from the bottom of the gas collection raise to a second gas level main drift 68 excavated at an elevation preferably below the elevation of the first gas collection main drift 50. The gas level and main access drift systems can be dual drifts for greater reliability, and the second gas level drift need not be directly below the first gas level drift. The gas level main drifts can be excavated at about the same elevation when the layout of the tract being developed permits. It is most convenient, however, to have the two gas level drift systems at different elevations to avoid intersections of the two drift systems. Many other variations will be apparent. The second gas collection drift system also includes a similar gas collection raise and lateral drift (not shown) providing gas communication between the second gas level main drift 68 and each of the other groups of retorts formed during the second pass.

Thus, the groups of in situ retorts formed during the second pass are connected to a common gas level drift system at a different elevation than the first gas level drift system for the retorts formed during the first pass. The second gas level main drift 68 is isolated from the first gas level drift 50 by a barrier 70 of unfragmented formation for inhibiting gas flow between the two main drifts. A gas-tight bulkhead 72 is installed in the cross drift 56 to prevent off gas from entering the main production level access drift 30 from the fragmented masses of the retorts formed in the second pass. Barriers of unfragmented formation also are left between other drifts in the second gas level drift system and the drifts of the first gas level drift system for inhibiting gas flow between the two gas level drift systems. Substantial intervening barrier pillars of unfragmented formation also are left between the gas collection raises and lateral drifts of the gas collection system for the first set of retorts and the gas collection raises and lateral drifts of the gas collection system of the second set of retorts.

Thus, the gas collection drift systems for the two sets of retorts are isolated from one another for inhibiting flow of off gas from the first gas level drift system to the second gas level drift system. Liquid products produced during operation of each retort in the second set are withdrawn by way of production level cross drift of each group of retorts, along with off gas produced from retorting operations. Off gas is withdrawn from each production level cross drift 50 by way of the gas collection raise 64 and lateral drift 66 connecting the production level cross drift to the second gas level main drift. The shale oil and water can be withdrawn separately from the production level drift and passed to above ground. Since the first and second gas level drifts are at different elevations and isolated from one another, the groups of retorts formed in the second pass can be connected to the second gas level drift during the second pass of retorting without re-entering the first gas level drift system. Having separate gas level drift systems permits orderly development of rows of retorts during the second pass of rotorting while other rows of retorts are being developed during the first pass of retorting.

It will be recognized that the description and drawings are schematic for indicating the presence of two gas levels for use during the first and second passes of retorting, respectively. In addition to being able to commence a second pass of retorting in barrier pillars before the first pass of retorting is completed in a given oil shale tract, the dual gas level system can be advantageous. Thus, each gas level can have a smaller cross-sectional area than would be required for a single gas level for the same quantity of production. A two-pass system permits increased production from a tract with limited additional capital expenditure, and the capital expenditure that is required is deferred until substantial production is obtained from the first pass of retorting.

What is claimed is:

1. A two-pass method for recovering liquid and gaseous products from a system of in situ oil shale retorts formed in a subterranean formation containing oil shale, such an in situ oil shale retort containing a fragmented permeable mass of formation particles containing oil shale, the method comprising the steps of:

forming a first set of in situ oil shale retorts in the subterranean formation containing oil shale, such a first set of in situ retorts including separate groups of in situ oil shale retorts formed in different horizontally spaced apart regions of the subterranean formation containing oil shale, leaving an intervening zone of unfragmented formation between adjacent groups of in situ retorts;

forming a first gas level drift system that communicates with fragmented masses of the separate groups of in situ retorts within the first set;

conducting retorting operations in at least one of the fragmented masses of the groups of in situ retorts within the first set for producing liquid and gaseous products of retorting;

withdrawing liquid products from the fragmented masses of the first set of in situ retorts that are being retorted;

withdrawing gaseous products from such fragmented masses of the first set of in situ retorts through the first gas level drift system;

forming a second set of in situ oil shale retorts in such intervening zones of unfragmented formation between adjacent groups of in situ retorts within the first set, leaving barriers of unfragmented formation between the second set of in situ retorts and such adjacent groups of in situ retorts within the first set for isolating retorting operations in the second set of in situ retorts from retorting operations in such adjacent groups of in situ retorts within the first set;

forming a second gas level drift system that communicates with the fragmented masses of the second set of in situ retorts, leaving sufficient unfragmented formation between the second gas level drift system and the first gas level drift system for preventing gas flow between the two gas level drift systems;

conducting retorting operations in at least one of the fragmented masses within the second set of in situ retorts for producing liquid and gaseous products of retorting;

withdrawing liquid products from the such fragmented masses of the second set of retorts which are being retorted; and withdrawing gaseous products from such fragmented masses of the second set of retorts through the second gas level drift system.

2. The method according to claim 1 including commencing retorting operations in the second set of in situ retorts after retorting operations have commenced in at least a portion of the in situ retorts within the first set.

3. The method according to claim 1 including forming at least a portion of the second gas level drift system at a different elevation from the elevation of the first gas level drift system.

4. The method according to claim 3 including conducting retorting operations in the second set of in situ retorts at least simultaneously with conducting of retorting operations in at least a portion of the in situ retorts within the first set.

5. The method according to claim 1 including conducting retorting operations in at least a portion of the first set of in situ retorts while the second gas level drift system is being formed.

6. The method according to claim 1 including forming retorts in the second set of in situ retorts after retorting operations in groups of retorts within the first set adjacent to such retorts in the second set have been conducted.

7. A two-pass method for developing a system of in situ oil shale retorts formed in a subterranean formation containing oil shale, such an in situ oil shale retort containing a fragmented permeable mass of formation particles containing oil shale; in which a first set of in situ oil shale retorts has been formed in a first pass through the subterranean formation containing oil shale; in which an intervening zone of unfragmented formation separates adjacent in situ oil shale retorts within the first set; and in which a first gas level drift system communicates with fragmented masses of such adjacent in situ retorts within the first set; the method comprising the steps of:

forming one or more intervening in situ oil shale retorts in such an intervening zone of unfragmented formation during a second pass through the subterranean formation containing oil shale; and forming a second gas level drift system that communicates with the fragmented mass of such an intervening in situ retort, the second gas level drift system being isolated from the first gas level drift system for preventing gas flow between the first gas level drift system and the second gas level drift system.

8. The method according to claim 7 including forming the second gas level drift system after retorting operations within such adjacent in situ retorts within the first set have been conducted.

9. The method according to claim 7 including leaving barriers of unfragmented formation between such an intervening in situ retort and such adjacent in situ retorts within the first set for isolating retorting operations in such an intervening in situ retort from retorting operations in such adjacent in situ retorts.

10. The method according to claim 7 including initiating retorting operations in such an intervening in situ retort after retorting operations have been commenced in at least a portion of the in situ retorts within the first set.

11. The method according to claim 7 including forming such an intervening in situ retort after retorting operations in such adjacent in situ retorts have been conducted.

12. The method according to claim 7 including forming such an intervening in situ retort before completion of retorting operations in such adjacent in situ retorts.

13. The method according to claim 7 including forming the second gas level drift system at a different elevation from the first gas level drift system.

14. A system of in situ oil shale retorts formed in a subterranean formation containing oil shale, such an in situ oil shale retort containing a fragmented permeable mass of formation particles containing oil shale, the system comprising:

a first set of in situ oil shale retorts formed in the subterranean formation containing oil shale, such a first set of retorts including separate spaced apart rows of retorts;

an intervening zone of unfragmented formation separating at least one row of retorts within the first set from an adjacent row of retorts within the first set;

at least one row of intervening in situ oil shale retorts formed in the intervening zone of unfragmented formation between such adjacent rows of in situ oil shale retorts within the first set;

a first gas level drift system in gas communication with fragmented masses of such adjacent rows of in situ oil shale retorts within the first set; and a second gas level drift system in gas communication with fragmented masses of such an intervening row of in situ retorts, the second gas level drift system being at a different elevation from the elevation of the first gas level drift system and being isolated from the first gas level drift system by a barrier of unfragmented formation for preventing gas flow between the first gas level drift system and the second gas level drift system.

15. The system of in situ oil shale retorts according to claim 14 including gas barriers of unfragmented formation separating such a fragmented mass of such an intervening in situ retort from fragmented masses of such adjacent in situ retorts within the first set.

16. The system of in situ oil shale retorts according to claim 14 in which such adjacent groups of in situ retorts within the first set comprise spent in situ retorts.

17. A system of in situ oil shale retorts formed in a subterranean formation containing oil shale, such an in situ oil shale retort containing a fragmented permeable mass of formation particles containing oil shale, the in situ retort system comprising:

a first set of in situ oil shale retorts formed in the subterranean formation containing oil shale, the in situ retorts in the first set including separate groups of in situ retorts which are horizontally spaced apart from one another in the subterranean formation containing oil shale;

a plurality of intervening zones of unfragmented formation, each intervening zone being between a pair of adjacent groups of in situ retorts within the first set;

a second set of in situ oil shale retorts formed in the subterranean formation containing oil shale, the in situ retorts in the second set including separate groups of in situ retorts which are formed in corresponding intervening zones of unfragmented formation between adjacent groups of in situ retorts within the first set;

a first production level drift communicating with fragmented masses of the in situ retorts in each group of in situ retorts within the first set;

a second production level drift communicating with fragmented masses of the in situ retorts in each group of in situ retorts within the second set;

a first gas level main drift communication with the first production level drifts for the groups of in situ retorts within the first set;

a second gas level main drift communicating with the second production level drifts for the groups of in situ retorts within the second set; and one or more barriers of unfragmented formation for preventing gas flow from the first gas level main drift and the first production level drifts to the second gas level main drift and the second production level drifts, and vice versa.

18. The system according to claim 17 in which the first gas level main drift is at a different elevation from the elevation of the second gas level main drift.

19. The system according to claim 17 in which in situ retorts within the first set are spent in situ retorts.

20. A two-pass method for developing a system of in situ oil shale retorts formed in a subterranean formation containing oil shale, such an in situ oil shale retort containing a fragmented permeable mass of formation particles containing oil shale; in which a first set of in situ oil shale retorts has been formed in a first pass through the subterranean formation containing oil shale; in which an intervening zone of unfragmented formation separates each adjacent group of the in situ oil shale retorts within the first set; in which a first gas level drift system communicates with fragmented masses of the groups of in situ oil shale retorts within the first set; and in which retorting operations have been commenced in fragmented masses within at least a portion of the in situ oil shale retorts within the first set for producing liquid and gaseous products of retorting and leaving spent in situ retorts, the method comprising the steps of:

forming a second set of in situ oil shale retorts in such an intervening zone of unfragmented formation during a second pass through the subterranean formation containing oil shale, such a second set of in situ oil shale retorts being formed in the intervening zone of unfragmented formation between adjacent groups of spent in situ oil shale retorts within such a first set of in situ retorts; and forming a second gas level drift system that communicates with fragmented masses in the second set of in situ retorts, the second gas level drift system being isolated from the first gas level drift system for preventing gas flow between the first gas level drift system and the second gas level drift system.

21. The method according to claim 20 including leaving barriers of unfragmented formation between the second set of in situ retorts and such adjacent spent in situ retorts within the first set for isolating the fragmented masses of the second set of in situ retorts from the spent in situ retorts of the first set.

22. The method according to claim 20 including forming at least a portion of the second gas level drift system at a different elevation from the elevation of the first gas level drift system.

23. A two-pass method for recovering liquid and gaseous products from an in situ oil shale retort system formed in a subterranean formation containing oil shale, such an in situ oil shale retort containing a fragmented permeable mass of formation particles containing oil shale, the method comprising the steps of: in a first pass, forming spaced apart rows of in situ oil shale retorts in the subterranean formation containing oil shale, adjacent rows of in situ oil shale retorts being separated by an intervening zone of unfragmented formation;

forming a first gas level drift system in fluid communication with fragmented masses of the rows of in situ retorts formed in the first pass;

conducting retorting operations in fragmented masses of the in situ retorts formed in the first pass for producing liquid and gaseous products of retorting;

withdrawing gaseous products of retorting from the in situ retorts formed in the first pass through the first gas level drift system; and in a second pass, forming one or more rows of in situ oil shale retorts in such an intervening zone of unfragmented formation, formation of at least a portion of the in situ retorts in the second pass being commenced after commencement of retorting operations in the in situ retorts formed in the first pass;

forming a second gas level drift system in fluid communication with fragmented masses of such in situ retorts formed in the second pass, leaving sufficient barriers of unfragmented formation between the first and second gas level drift systems to prevent gas communication between the two gas level drift systems;

conducting retorting operations in fragmented masses within the groups of in situ retorts formed in the second pass for producing liquid and gaseous products of retorting; and withdrawing gaseous products of retorting from such a group of in situ retorts formed in the second pass through the second gas level drift system.

24. The method according to claim 23 including forming at least a portion of the second gas level drift system at an elevation different from the elevation of the first gas level drift system.

25. A two-pass method for developing an in situ oil shale retort system, such an in situ oil shale retort containing a fragmented permeable mass of formation particles containing oil shale, the method comprising the steps of:

forming spaced apart groups of in situ oil shale retorts during a first pass through the subterranean formation containing oil shale, leaving intervening barrier pillars of unfragmented formation between adjacent groups of in situ retorts formed during the first pass;

forming a first gas level drift system communicating with in situ retorts formed during the first pass;

conducting retorting operations in at least a portion of the in situ retorts formed during the first pass and withdrawing off gas to the first gas level drift system from such in situ retorts formed during the first pass;

thereafter, during a second pass of retorting, forming intervening groups of in situ oil shale retorts in the intervening barrier pillars between the groups of in situ retorts formed during the first pass; and forming a second gas level drift system communicating with the in situ retorts formed during the second pass, the second gas level drift system being formed at a different level and being isolated from the first gas level drift system for inhibiting gas flow from the first gas level drift system to the second gas level drift system.

26. The method according to claim 25 including conducting retorting operations in the groups of in situ retorts formed during the second pass and withdrawing off gas to the second gas level drift system from the in situ retorts formed during the second pass.

27. The method according to claim 25 including isolating the two gas level drift systems by intervening zones of unfragmented formation which are impermeable to gas flow.

28. A two-pass method for recovering liquid and gaseous products from an in situ oil shale retort system formed in a subterranean formation containing oil shale, such an in situ oil shale retort containing a fragmented permeable mass of formation particles containing oil shale, the method comprising the steps of: in a first pass, forming spaced apart rows of in situ oil shale retorts in the subterranean formation containing oil shale, adjacent rows of such in situ retorts being separated by an intervening zone of unfragmented formation;

forming a first gas level drift system in fluid communication with the fragmented masses in the rows of in situ retorts formed in the first pass;

conducting retorting operations in fragmented masses of the in situ retorts formed in the first pass for producing liquid and gaseous products of retorting;

withdrawing gaseous products of retorting from the in situ retorts formed in the first pass through the first gas level drift system; and in a second pass, forming one or more rows of in situ oil shale retorts in such an intervening zone of unfragmented formation, formation of at least a portion of the in situ retorts in the second pass being commenced after completion of retorting operations in adjacent rows of in situ retorts formed in the first pass;

forming a second gas level drift system in fluid communication with the fragmented masses of such in situ retorts formed in the second pass, leaving sufficient barriers of unfragmented formation between the first and second gas level drift systems to prevent gas communication between the two gas level drift systems;

conducting retorting operations in fragmented masses within the groups of in situ retorts formed in the second pass for producing liquid and gaseous products of retorting; and withdrawing gaseous products of retorting from such a group of in situ retorts formed in the second pass through the second gas level drift system.

29. The method according to claim 28 including forming at least a portion of the second gas level drift system at an elevation different from the elevation of the first gas level drift system.

30. A method for producing liquid and gaseous products of oil shale retorting from a tract having a subterranean formation containing oil shale, comprising the steps of:

forming and processing a first set of in situ oil shale retorts in the formation in a first pass across the tract for producing liquid and gaseous products of retorting, such retorts in the first set being in rows leaving a barrier pillar of unfragmented formation between at least a portion of such rows;

withdrawing off gas containing such gaseous products from such retorts in the first set by way of a first gas level drift system during such processing;

forming and processing a second set of in situ oil shale retorts in a second pass across the tract for producing liquid and gaseous products of retorting, such retorts in the second set being in rows in the barrier pillars between rows of retorts in the first set; and withdrawing off gas containing such gaseous products from such retorts in the second set by way of a second gas level drift system during such processing, the second gas level drift system being sufficiently isolated from the first gas level drift system to prevent gas flow between the two gas level drift systems.

31. The method according to claim 29 comprising:

excavating a first gas level main drift in the first gas level drift system at a first elevation; and excavating a second gas level main drift in the second gas level drift system at a second elevation different from the first elevation.

32. The method according to claim 30 comprising forming and processing a portion of the retorts in the second pass before completion of forming and processing all of the retorts in the first pass.

33. A system of in situ oil shale retorts formed in a subterranean formation containing oil shale, such an in situ oil shale retort containing a fragmented permeable mass of formation particles containing oil shale, the in situ retort system comprising:

a first set of in situ oil shale retorts formed in the subterranean formation in spaced apart rows;

a second set of in situ oil shale retorts formed in the subterranean formation in rows interleaved with the rows of in situ retorts of the first set;

a first gas level drift system connected to retorts in the first set for withdrawing off gas from each row of such retorts in the first set to a first gas level main drift;

a second gas level drift system connected to retorts in the second set for withdrawing off gas from each row of such retorts in the second set to a second gas level main drift; and at least one barrier of unfragmented formation for isolating the second gas level drift system and the second gas level main drift from the first gas level drift system and the first gas level main drift for preventing gas flow between the two gas level drift systems and the two gas level main drifts.

34. A system of in situ oil shale retorts formed in a subterranean formation containing oil shale, such an in situ oil shale retort containing a fragmented permeable mass of formation particles containing oil shale, the in situ retort system comprising:

a first row of spent in situ oil shale retorts;

a second row of spent in situ oil shale retorts spaced apart from the first row by an intervening zone of unfragmented formation;

a first gas level drift in gas communication with retorts in the first and second rows of spent in situ oil shale retorts;

a third row of in situ oil shale retorts in the intervening zone of unfragmented formation; and a second gas level drift in gas communication with retorts in the third row for withdrawing off gas from such retorts in the third row, the second gas level drift being at an elevation different from the elevation of the first gas level drift and being sufficiently isolated from the first gas level drift by a barrier of unfragmented formation for preventing gas flow between the two gas level drifts.

35. The system according to claim 34 including a first gas level main drift in gas communication with the first gas level drift for withdrawing off gas from retorts in the first and second rows; and a second gas level main drift in gas communication with the second gas level drift for withdrawing off gas from the second gas level drift, the second gas level main drift being isolated from the first gas level main drift by a barrier of unfragmented formation for preventing gas flow between the two gas level main drifts.

* * * * *